US008227991B2

(12) United States Patent
Stappers et al.

(10) Patent No.: US 8,227,991 B2
(45) Date of Patent: Jul. 24, 2012

(54) METAL HALIDE LAMP COMPRISING AN IONISABLE SALT FILLING

(75) Inventors: Oscar Gerard Stappers, Eindhoven (NL); Willem Van Erk, Eindhoven (NL); Wouter Edgard Koen Broeckx, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 19 days.

(21) Appl. No.: 12/595,642

(22) PCT Filed: Apr. 18, 2008

(86) PCT No.: PCT/IB2008/051492

§ 371 (c)(1),
(2), (4) Date: Oct. 13, 2009

(87) PCT Pub. No.: WO2008/129486

PCT Pub. Date: Oct. 30, 2008

(65) Prior Publication Data

US 2010/0052531 A1 Mar. 4, 2010

(30) Foreign Application Priority Data

Apr. 20, 2007 (EP) ..... 07106601

(51) Int. Cl.
*H01J 61/20* (2006.01)
*H01J 61/30* (2006.01)

(52) U.S. Cl. ..... 313/637; 313/640

(58) Field of Classification Search ..... 313/637, 313/640

See application file for complete search history.

(56) References Cited

U.S. PATENT DOCUMENTS

| | | | | |
|---|---|---|---|---|
| 2005/0104500 | A1 | 5/2005 | Haverlag et al. | |
| 2005/0212436 | A1 | 9/2005 | Brock | |
| 2006/0164016 | A1 | 7/2006 | Rintamaki et al. | |
| 2006/0164017 | A1 * | 7/2006 | Rintamaki et al. | 313/640 |
| 2009/0121633 | A1 * | 5/2009 | Van Esveld et al. | 313/621 |

FOREIGN PATENT DOCUMENTS

| | | | |
|---|---|---|---|
| EP | 1473758 | A2 | 11/2004 |
| WO | 2005088673 | A2 | 9/2005 |
| WO | 2005088675 | A1 | 9/2005 |
| WO | 2006078632 | A1 | 7/2006 |
| WO | 2006117713 | A3 | 11/2006 |

* cited by examiner

*Primary Examiner* — Anne Hines
*Assistant Examiner* — Jacob R Stern

(57) ABSTRACT

The invention provides a metal halide lamp with a ceramic discharge vessel and two electrodes. The discharge vessel encloses a discharge volume containing an ionisable salt filling. The ionisable salt filling comprises 3.5-82 mol % sodium iodide, 0.5-8.5 mol % thallium iodide, 14-92 mol % calcium iodide, 0.5-5.5 mol % cerium iodide and 0.5-3.5 mol % indium iodide. The mol percentages are relative to the total amount of ionisable salt filling. The lamp is dimmable, at least in a range of 50-100% of nominal intensity, while maintaining its light-technical properties and while not substantially deviating from the black body locus. Further, the lamp has a relatively high efficacy. Further, the lamp can be operated horizontally and vertically, i.e. the lamp is suitable for universal burning.

14 Claims, 5 Drawing Sheets

METAL HALIDE LAMP COMPRISING AN IONISABLE SALT FILLING

FIELD OF THE INVENTION

The present invention relates to a metal halide lamp comprising an ionisable salt filling and especially relates to a metal halide lamp with a ceramic discharge vessel, especially a shaped ceramic discharge vessel, comprising such a salt filling.

BACKGROUND OF THE INVENTION

Metal halide lamps are known in the art and are for instance described in EP 0215524 and WO 2006/046175. Such lamps operate under high pressure and have burners or ceramic discharge vessels comprising ionisable gas fillings of for instance NaI (sodium iodide), TlI (thallium iodide), $CaI_2$ (calcium iodide) and/or $REI_n$. $REI_n$ refers to rare earth iodides. Characteristic rare earth iodides for metal halide lamps are $CeI_3$, $PrI_3$, $HoI_3$, $DyI_3$ and $TmI_3$.

WO 2005/088673 discloses a metal halide lamp suitable as a projection lamp, for instance as a vehicle headlamp, comprising a discharge vessel surrounded by an outer envelope with clearance and having a ceramic wall which encloses a discharge space filled with a filling comprising an inert gas, such as xenon, and an ionisable salt, wherein in the discharge space two electrodes are arranged whose tips have a mutual interspacing so as to define a discharge path between them, with the special feature that the ionisable salt comprises NaI, TlI, $CaI_2$ and $XI_3$, where X is selected from the group comprising rare earth metals.

WO 2005/088675 discloses a metal halide lamp comprising a discharge vessel surrounded by an outer envelope with clearance and having a ceramic wall which encloses a discharge space filled with a filling comprising an inert gas, such as xenon (Xe), and an ionisable salt, wherein in said discharge space two electrodes are arranged whose tips have a mutual interspacing so as to define a discharge path between them, with the special feature that said ionisable salt comprises NaI, TlI, $CaI_2$ and X-iodide, where X is selected from the group comprising rare earth metals. The ionisable salt may also comprise a halide selected from Mn and In.

Most of the present-day discharge vessels for metal halide lamps have a spherical shape, such as for instance described in DE 20205707, a cylindrical shape, such as for instance described in EP 0215524 or WO 2006/046175, or an extended spherical shape such as for example described in EP 0841687 (U.S. Pat. No. 5,936,351). The latter document describes a ceramic discharge vessel for a high-pressure discharge lamp formed of a cylindrical central part and two hemispherical end pieces, the length of the central part being smaller than or equal to the radius of the end pieces. In this way, the isothermy of the discharge vessel is improved.

SUMMARY OF THE INVENTION

Those prior art metal halide lamps or ceramic discharge metal halide lamps (CDM lamps) have as a drawback that such lamps are not dimmable without substantially affecting the light-technical properties such as color rendering as indicated by the general color rendering index Ra, also sometimes known as CRI, color point, etc. Further, even if such lamps were dimmable, it would appear that the color point shifts too much away from the black body locus (BBL), whereas it is desired that the color point stays relatively close to the BBL in order to maintain the impression of white light. Especially lamps with TlI containing salt fillings show a green shift and a substantial reduction in CRI when dimming, which aspects are not desired. It is further desirable to provide metal halide lamps that may have a variable color point when dimming the lamp, while still having a sufficient CRI within the dimming range and, preferably, staying close to the BBL when the color point varies.

Hence, it is an object of the invention to provide an alternative metal halide lamp, which preferably further obviates one or more of the above-described drawbacks and/or provides one or more of the desired features described above.

To this end, the invention provides a metal halide lamp comprising a ceramic discharge vessel (i.e. a Ceramic Discharge Metal halide (CDM) lamp), the discharge vessel enclosing a discharge volume containing an ionisable salt filling, and the ionisable salt filling comprising 3.5-82 mol % sodium iodide, 0.5-8.5 mol % thallium iodide, 14-92 mol % calcium iodide, 0.5-5.5 mol % cerium iodide and 0.5-5 mol % indium iodide (the mol percentages being relative to the total amount of ionisable salt filling). The total amounts of the individual ionisable salts add up to 100 mol %, as will be clear to the person skilled in the art.

The metal halide lamp according to the invention has an efficacy of at least 100 lm/W at nominal operation and an efficacy of at least 80 lm/W at 50% of nominal operation, also indicated as "nominal operation power". The terms "nominal operation" or "nominal operation power" herein mean operation at the maximum power and conditions for which the lamp has been designed to be operated. Further, the CRI in the range of 50-100% of nominal operation is at least 85. Hence, a good color rendering is obtained over a substantial part of the dimming range. It further appears that the metal halide lamp according to the invention is dimmable in a range of the color temperature Tc (also known as correlated color temperature CCT) of about 2800-5000 K while still having a good color rendering and, at increasing dim percentages, substantially not deviating from the BBL. The Ra can even be maintained at about 80 or higher in a dimming range of about 40-100% of nominal operation and at least for dim percentages of 50% and more the deviation from the BBL in this range is equal to or less than about 15 scale parts of Standard Deviation of Color Matching SDCM, more preferably 10 SDCM. The SDCM is a unit over which a color may deviate with little or no noticeable differences for the human perception. Advantageously, lamps can be provided which emit light during operation having a color temperature as low as 2800 K.

The lamps of the invention have ionisable salt fillings comprising 0.5-5 mol % indium iodide, more preferably 0.5-3 mol % (relative to the total amount of ionisable salt filling). At smaller and larger indium concentrations than the concentration range indicated herein, it appears that the light-technical properties deteriorate. Especially at higher concentrations than about 5 mol %, there is a relatively strong shift of the color point to below the BBL. At lower concentrations than about 0.5 mol %, the desired light-technical properties are not obtained and a possible loss of In over lifetime will have a relatively huge impact on the resulting color properties of the light generated by the lamp.

In another embodiment, the ionisable salt filling comprises 4-30 mol % sodium iodide, 0.5-3.5 mol % thallium iodide, and 65-92 mol % calcium iodide, as well as 0.5-5.5 mol % cerium iodide (preferably 1.5-3.5 mol %) and 0.5-5 mol % indium iodide (preferably 0.5-3 mol %). Such lamps have a good color rendering with a Ra of about 85 or higher at nominal operation (i.e. 100% of nominal operation) and have a color point at nominal operation in the range of about 2800-5000 K.

In a preferred embodiment, the lamp of the invention has an external wall load of about 20-30 W/cm$^2$ (this is the wall load at nominal operation power). At higher wall loads, dimming may lead to a substantial shift in color point.

In order to provide alternative lamps, for instance having another color point or color rendering or other desired light-technical properties, in addition to cerium, also other rare earths can be added to the salt mix. Hence, in an embodiment the invention also provides a metal halide lamp, wherein the ionisable salt filling further comprises one or more elements selected from the group consisting of scandium, yttrium and rare earth metals other than Ce, wherein preferably the molar percentage ratio X-iodide/(NaI+TlI+$CaI_2$+InI+X-iodide) is above 0% and up to and including 10%, in particular in the range of 0.5-7%, more in particular in the range of 1-6%, where X-iodide refers to Ce and optionally one or more elements selected from the group consisting of scandium, yttrium and rare earth metals other than Ce. When X only refers to Ce, the preferred ratio Ce-iodide/(NaI+TlI+$CaI_2$+InI+X-iodide) is 0.5-5.5%. When, in addition to Ce, also other rare earth metals and/or Sc and/or Y are present, the total molar percentage ratio of these metals is larger than 0% and up to 10%, while Ce preferably being in the range of 0.5-5.5%.

In a further preferred embodiment, the ionisable salt filling may further comprise Mn iodide, especially 0.5-10 mol % Mn iodide. Advantageously, the addition of Mn provides the effect of increasing the color rendering. When Mn is added to the salt filling, in the denominator of the above formulas also the molar amount of Mn is included.

The discharge vessel may have any shape, such as described above, like a spherical shape, a cylindrical shape, an extended spherical shape, etc, but in a specific embodiment, especially advantageous at a nominal operation power above about 150 W, the invention provides in a specific embodiment a metal halide lamp comprising a ceramic discharge vessel, the discharge vessel having a vessel wall enclosing a discharge space containing an ionisable filling, the discharge space further enclosing electrodes having electrode tips arranged opposite each other and arranged to define a discharge arc between the electrode tips during operation of the lamp, the discharge vessel having a spheroid-like shape with a main axis and a length L1 (outer length), and the discharge vessel having a largest internal diameter d1 and a largest outer diameter d2, the discharge vessel further having curved extremities, the curved extremities having a curvature with a radius r3, an aspect ratio L1/d2 being $1.1 \leqq L1/d2 \leqq 2.2$ and a first shape parameter r3/d2 being $0.7 \leqq r3/d2 \leqq 1.1$.

Advantages of this lamp are that especially a lamp which such a discharge vessel is dimmable while maintaining desired light-technical properties. Further, the lamp can be operated horizontally and vertically, i.e. the lamp is suitable for universal burning, that is burning at a universal burning position. Further, it appears that the lamp is less apt to form cracks in the discharge vessel than state of the art lamps. For instance, when a lamp is used with a shape parameter of 0.5 (which is outside the range of this preferred embodiment), at high powers often small cracks in the wall of the discharge vessel are observed. Likewise, discharge vessels of lamps with a large shape parameter often show cracks. However, the lamp of this specific embodiment of the invention has a discharge vessel shape that provides a stable discharge vessel while allowing high power during operation of the lamp, and further high efficacy and universal burning. Another advantage of these shaped discharge vessels in comparison to vessels having a cylindrical shape is a relatively large lumen output, a better dimmabilitiy and a relatively high stability.

In a preferred embodiment, the electrode tips are arranged at a distance L3 from each other and a second space parameter, L3/L1, is in the range $0.4 \leqq L3/L1 \leqq 0.7$. Within this range, a stable discharge vessel (operation) is found, whereas outside this range, the phenomenon of formation of cracks strongly increases.

In a specific embodiment, the discharge vessel further comprises protruding end plugs, which protruding end plugs surround at least part of the electrodes.

BRIEF DESCRIPTION OF THE DRAWINGS

Embodiments of the invention will now be described, by way of example only, with reference to the accompanying schematic drawings in which corresponding reference symbols indicate corresponding parts:

FIG. 5 depicts the dimming behaviour in a CIE x,y-diagram of amongst others a lamp according to the invention (b) comprising In and reference lamps (c and d) not comprising In.

DETAILED DESCRIPTION OF THE PREFERRED EMBODIMENTS

General Description of the Lamp

Figure 1:
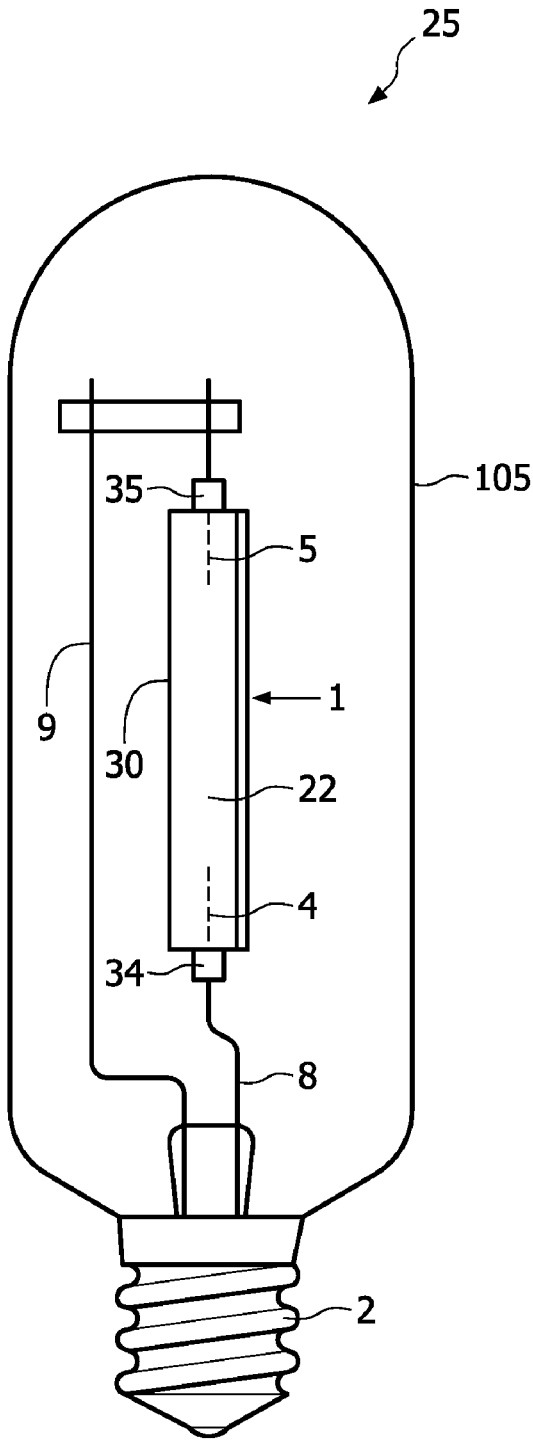
FIG. 1 schematically depicts a general embodiment of the lamp according to the invention in a side elevation, without details of the discharge vessel.

Metal halide lamps or ceramic discharge metal (CDM) halide lamps as such are generally known. A schematic Figure of an embodiment of such a metal halide lamp is depicted in FIG. 1. In general, metal halide lamps, here indicated with reference number 25, comprise a discharge vessel 1 surrounded by an outer envelope 105 with clearance and having a ceramic wall or vessel wall 30 (with internal surface 12 and external surface 13) which encloses a discharge space 22 filled with a filling comprising an inert gas, such as xenon (Xe) or argon (Ar), and an ionisable salt, and in said discharge space 22 two electrodes 4 and 5 are arranged. The discharge vessel 1 is surrounded by outer bulb or outer envelop 105 which is provided with a lamp cap 2 at one end. The outer envelop 105 may be in vacuum or filled with an inert gas such as nitrogen. A discharge will extend between the electrodes 4,5 when the lamp is operating. The electrode 4 is connected to a first electrical contact forming part of the lamp cap 2 via a current lead through conductor 8. The electrode 5 is connected to a second electrical contact forming part of the lamp cap 2 via a current lead through conductor 9.

In the schematic FIGS. 1-4, the discharge vessel 1 further comprises protruding end plugs 34,35, each at one side and each arranged to enclose at least part of the electrodes 4,5, respectively. However, the invention is also directed to discharge vessels 1 which do not comprise such protruding end plugs 34,35 (see also below).

In this description and these claims, the ceramic wall 30 is understood to mean both a wall of metal oxide such as, for example, sapphire or densely sintered polycrystalline $Al_2O_3$ and metal nitride, for example, AlN. According to the state of the art, these ceramics are well suited to form translucent discharge vessel walls 30.

Figure 2:
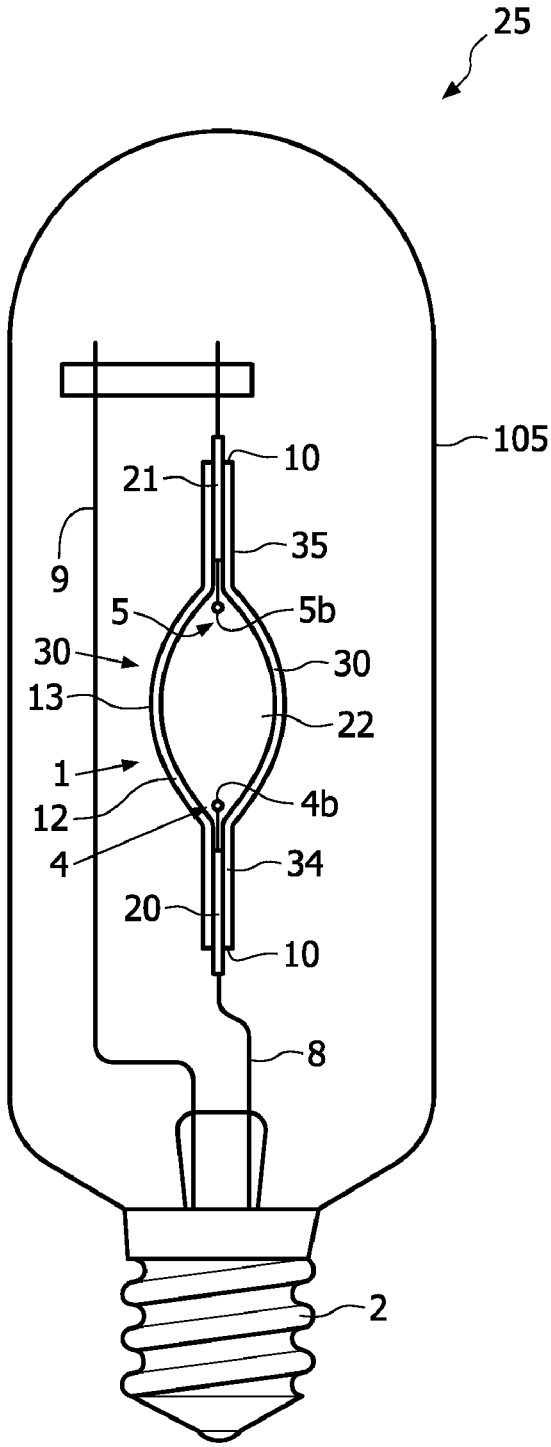
FIG. 2 schematically depicts a general embodiment of the lamp according to the invention in a side elevation having a shaped discharge vessel (not on scale) as described herein.

FIG. 2 shows in more detail a preferred embodiment of the lamp. Here a shaped discharge vessel 1 is schematically depicted. The lamp shown is not drawn on scale. FIG. 2 shows that the electrodes have electrode tips 4*b*,5*b* having a mutual interspacing so as to define a discharge path between them during operation of the lamp. In the embodiment, each electrode 4,5 is supported by a current lead through conductor 20,21 entering the discharge vessel 1. The current lead through conductors 20,21 preferably consist of a first part made of an halide resistant material, such as for instance a Mo—$Al_2O_3$ cermet, and a second part made of for instance niobium. Niobium is chosen because this material has a coefficient of thermal expansion corresponding to that of the discharge vessel 1 in order to prevent leakage of the lamp 25. Other possible constructions are known, for example, from EP0587238 (incorporated herein by reference, wherein a Mo coil-to-rod configuration is described). The current lead through conductors may be sealed into the protruding end plugs 34,35 with seals 10.

General Description of the Ionisable Filling

The ionisable filling in general comprises a salt (including a mixture of salts), which herein comprises 3.5-82 mol % sodium iodide, 0.5-8.5 mol % thallium iodide, 14-92 mol % calcium iodide, 0.5-5.5 mol % cerium iodide and 0.5-5 mol % indium iodide, the mol percentages being relative to the total amount of ionisable salt filling. In a preferred embodiment, the ionisable salt filling comprises 4-30 mol % sodium iodide, 0.5-3.5 mol % thallium iodide, and 65-92 mol % calcium iodide, as well as 0.5-5.5 mol % cerium iodide (preferably 1.5-3.5 mol %) and 0.5-5 mol % indium iodide (preferably 0.5-3 mol %). In a variant, the ionisable salt filling comprises at least 70 mol % calcium iodide, such as 75 mol %, relative to the total amount of ionisable salt filling. In another variant, the ionisable salt filling comprises 3.5-25 mol % sodium iodide, such as 3.5-20 mol %, relative to the total amount of ionisable salt filling.

The ionisable filling used in the invention may further comprise one or more components selected from the group consisting of iodides of Li, K, Rb, Cs, Mg, Sr, Ba, Sc, Y, La, Pr, Nd, Sm, Eu, Gd, Tb, Dy, Ho, Er, Tm, Yb, Lu, Sn, Mn and Zn, especially one or more components selected from the group consisting of LiI, KI, RbI, CsI, $MgI_2$, $CaI_2$, $SrI_2$, $BaI_2$, $ScI_3$, $YI_3$, $LaI_3$, $PrI_3$, $NdI_3$, $SmI_2$, $EUI_2$, $GdI_3$, $TbI_3$, $DyI_3$, $HoI_3$, $ErI_3$, $TmI_3$, $YbI_2$, $LuI_3$, $SnI_2$, $MnI_2$ and $ZnI_2$. Further, the discharge space 22 contains in general Hg (mercury) and further contains a starter gas such as Ar (argon) or Xe (xenon), as known in the art. In a preferred embodiment of a lamp in accordance with the invention, the discharge vessel 1 further contains mercury (Hg). In an alternative embodiment, the discharge vessel 1 is mercury-free. Herein, the amounts of filling do not take into account the amount of mercury present. Mercury is dosed to the discharge vessel 1 in amounts known to the person skilled in the art.

Preferably, the ionisable filling comprises NaI, TlI, $CaI_2$ and X-iodide, where X is one or more elements selected from the group comprising rare earth metals, yttrium and scandium, and X comprises at least Ce. Thus, X can be formed by a single element or by a mixture of two or more elements. Herein, for the sake of simplicity, the terms "rare earth and "X" include Sc and Y. Rare earth elements include lanthanum, cerium, praseodymium, neodymium, samarium, europium, gadolinium, terbium, dysprosium, holmium, erbium, thulium, ytterbium and lutetium.

Preferably, elements other than Ce are selected from the group comprising Sc, Y, La, Pr, Gd, Tb, Dy, Ho, Er, Tm, Yb, Lu, and Nd. The elements Sc, Y, La, Ce, Pr, Nd, Gd, Tb, Dy, Ho, Er, Tm, Yb, Lu, Na, Tl, Ca and I stand for scandium, yttrium, lanthanum, cerium, praseodymium, neodymium, gadolinium, terbium, dysprosium, holmium, erbium, thulium, ytterbium, lutetium, sodium, thallium, calcium and iodine, respectively. Hence, X-iodide may also include a plurality of different iodides. In a further embodiment, the ionisable filling further comprises halides, especially iodides, of manganese.

In a preferred embodiment of the lamp 25 in accordance with the invention, X is the total amount of rare earth, scandium and yttrium and the molar percentage ratio X-iodide/(NaI+TlI+$CaI_2$+InI+X-iodide (+ optionally $MnI_2$)) lies above 0% up to a maximum of 10%, in particular in the range of 0.5-7%, more in particular in the range of 1-6%. When X only refers to Ce, the preferred ratio Ce-iodide/(NaI+TlI+$CaI_2$+InI+X-iodide (+ optionally $MnI_2$)) is 0.5-5.5% (as defined above). When, in addition to Ce, also other rare earth metals and/or Sc and/or Y are present, the total molar percentage ratio of these metals is larger than 0% and maximally 10%, while Ce being in the range of 0.5-5.5%. At too low an amount of X, experiments have shown that the electrodes may reach too high temperature values to operate satisfactorily. At amounts of X above the indicated maximum it becomes more difficult to maintain a W-halide cycle that prevents or reduces the deposition of tungsten on the wall of the discharge vessel 1 during lamp operation.

Preferably, X being the total amount of rare earth (including Sc and Y), the molar percentage ratio $CaI_2$/(NaI+TlL+$CaI_2$+InI+X-iodide (+ optionally $MnI_2$)) is in the range of 14-92%. In another preferred embodiment of a lamp according to the invention, the amount of NaI, TlL, $CaI_2$, InI and X-iodide (+ optionally $MnI_2$) is in the range of 0.001-0.5 g/$cm^3$, in particular in the range of 0.005-0.3 g/$cm^3$. The volume of the discharge vessel particularly ranges between 0.05-10.0 $cm^3$, depending on the lamp power. Characteristic amounts of ionisable gas fillings are salt doses of about 5-70 mg, such as 5-50 mg. Nominal operation, i.e. stable nominal operation, means in this respect that the lamp 25 is operated at a power and voltage for which it is designed. The designed power of the lamp 25 is called the nominal power or rated power. Wall load as defined herein is the lamp power divided by the surface of the external wall 13 excluding the optional protruding plugs 34,35. Characteristic wall loads of the discharge vessel wall surface 13 of the lamp 25 in accordance with the invention are in the range of about 20-30 W/$cm^2$, especially in the range of about 20-28 W/$cm^2$ (i.e. the external wall load at nominal operation power). The loads of the internal wall surface 12 are generally in the range of about 25-35 W/$cm^2$.

Dimmability

Figure 5:
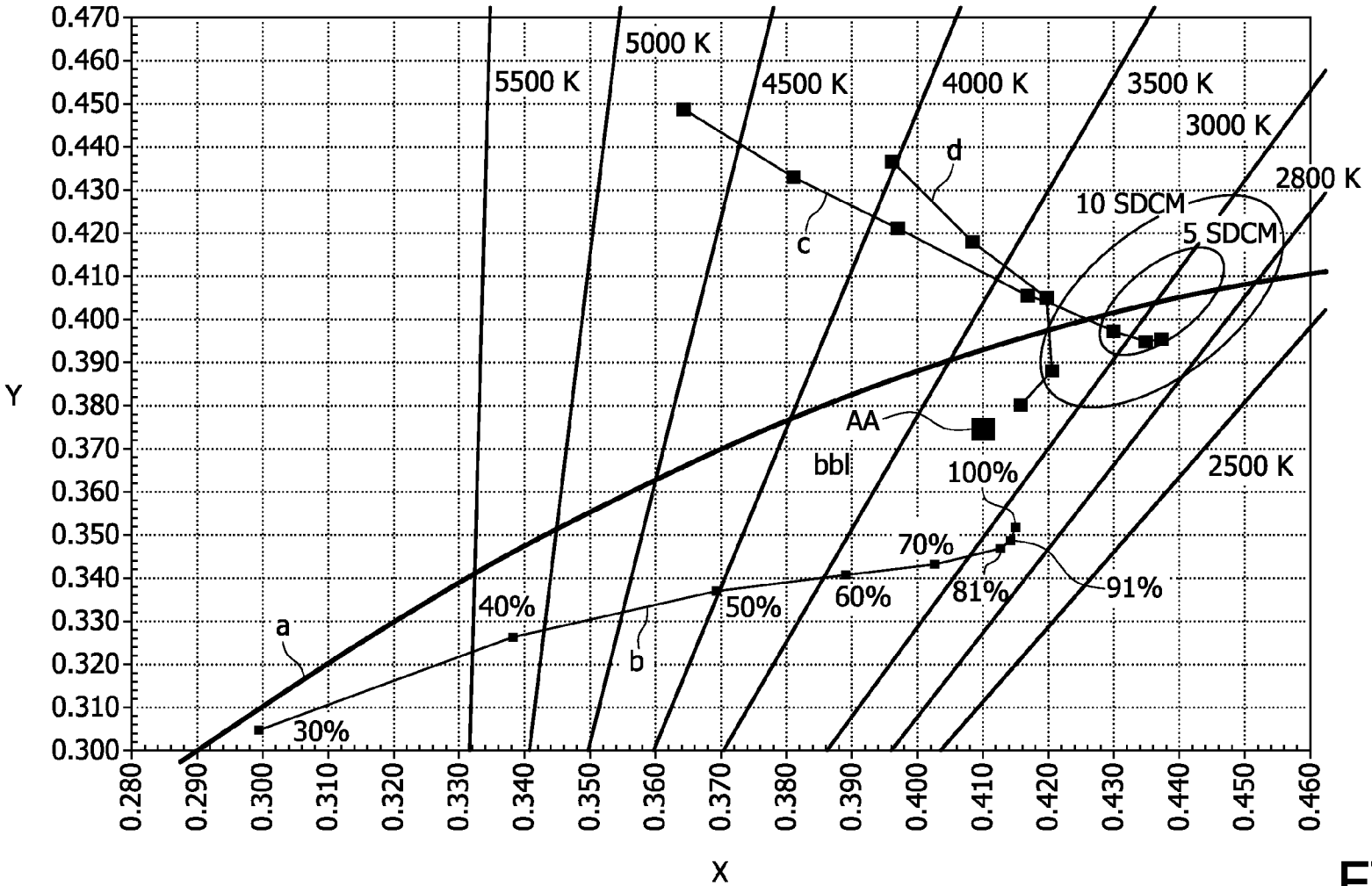

Herein, the term "dimming range" refers to the range wherein the lamp can be dimmed without substantially affecting the light-technical properties, assuming nominal operation to be 100% (which is also indicated as 100% of nominal operation). The lamp of the invention can be dimmed in a range to about 50% of nominal operation (i.e. 50-100% of nominal operation), while having a Ra of at least 80, or even at least 85 (see also table 4 below). A Ra of at least 80 can be obtained even in the dimming range of about 40-100% of nominal operation. In this dimming range, an efficacy above 80 lm/W, or even above 85 lm/W can be obtained, while in the range of about 40-100% of nominal operation, over the whole range, the efficacy is over about 75 lm/W. The color temperature in the dimming range of 50-100% of nominal operation may vary in the range of about 2800-5000 K, in a variant over a range of at least 1500 K. The deviation from the BBL for large dimming percentages of the lamp of the invention is within the range of about 15 SDCM, more preferably 10 SDCM. Since the lamp of the invention provides a color shift as a function of dimming substantially parallel to the BBL, there is, unlike prior art lamps (see also FIG. 5), no substantial increase in deviation from the BBL with dimming. FIG. 5 shows for a lamp according to the invention (b) and prior art lamps (c and d; not containing InI) curves for the position of the color point as a function of the dimming percentage between 100-30% of nominal operation). At external wall loads above about 30 W/cm$^2$, the color point shows a sharp deviation from the color points of the dimming range. Consequently, a curve representing the position of the color point as a function of the power of the lamp with such high wall loads may not be substantially parallel to the BBL.

Shaped Discharge Vessel

Figure 3:
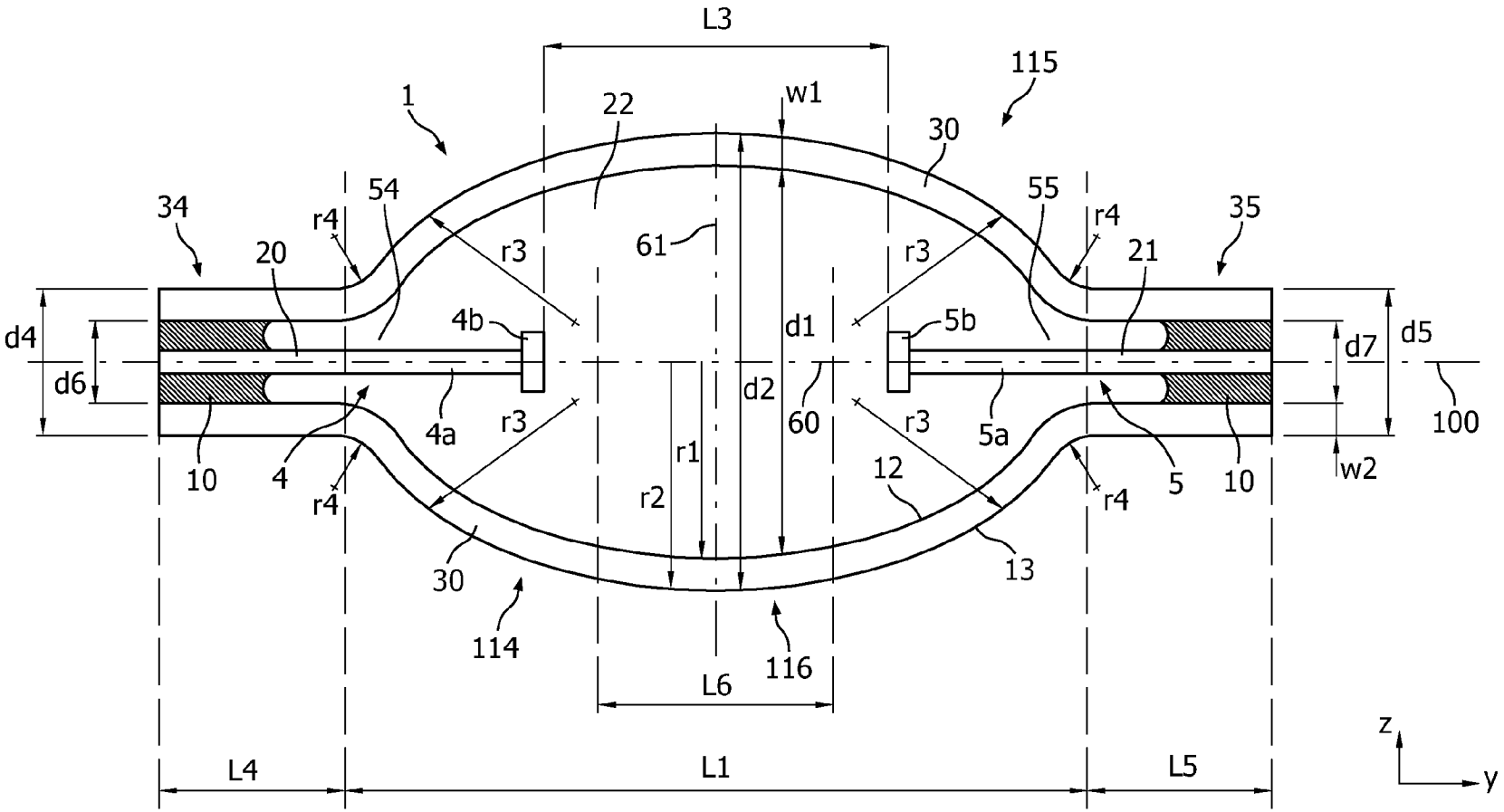
FIG. 3 schematically shows in more detail the shaped discharge vessel of the lamp according to an embodiment of the invention (not on scale)

Having described the general aspects of the lamp 25 and the gas filling, now a preferred embodiment of the discharge vessel of the lamp 25 of the invention is described in detail. A preferred embodiment, including optional features such as the protruding end plugs 34,35 is schematically depicted in FIG. 3 (not on scale). FIG. 3 shows an embodiment of discharge vessel 1 of a metal halide lamp 25 having a ceramic wall 30 which encloses a discharge space 22 containing an ionisable filling. Two, for instance, tungsten electrodes 4,5 with tips 4*b*, 5*b* at a mutual distance L3, are located in the discharge vessel 1. In this schematically depicted embodiment, the discharge vessel 1 is closed by means of ceramic protruding end plugs 34,35 which enclose, with a small clearance, current lead-through conductors 20,21 to electrodes 4,5 positioned in the discharge vessel 1 and are connected to these conductors 20,21 in a gas tight manner by means of a melting-ceramic joint or sealing 10 at ends remote from the discharge space 22 (see also above). However, the invention is not confined to the embodiment depicted in FIG. 3; see for instance also FIG. 4. The description of the discharge vessel 1 below first concentrates on the general aspects of the shaped discharge vessel 1 of the lamp 25 of the invention, and then deals with some preferred embodiments.

The discharge vessel 1 has a vessel wall 30 enclosing the discharge space 22 containing the ionisable filling. The discharge space encloses electrodes 4,5 with electrode tips 4*b*,5*b*.

The discharge vessel 1 has a spheroid-like shape with a main axis 60 and an outer length L1, a largest internal diameter d1 and a largest outer diameter d2. The discharge vessel 1 further has curved extremities 114,115 and openings 54,55 at (or in) the curved extremities 114,115. These openings 54,55 are arranged to surround the electrodes 4,5. These curved extremities 114,115 have a curvature with radius r3. The shaped discharge vessel 1 of the lamp of the invention is defined by an aspect ratio AR=L1/d2 and a first shape parameter SP=r3/d2.

Spheroids are known in the art and are obtained by rotating an ellipse about one of its principal axes. The discharge vessel 1 according to a preferred embodiment of the invention has a spheroid-like shape, more especially a prolate spheroid-like shape (i.e. a shape like a rugby ball). A prolate spheroid has a main axis, here indicated with reference number 60, and a minor axis, here indicated with reference number 61; the main axis 60 is larger than the minor axis 61.

Figure 4:
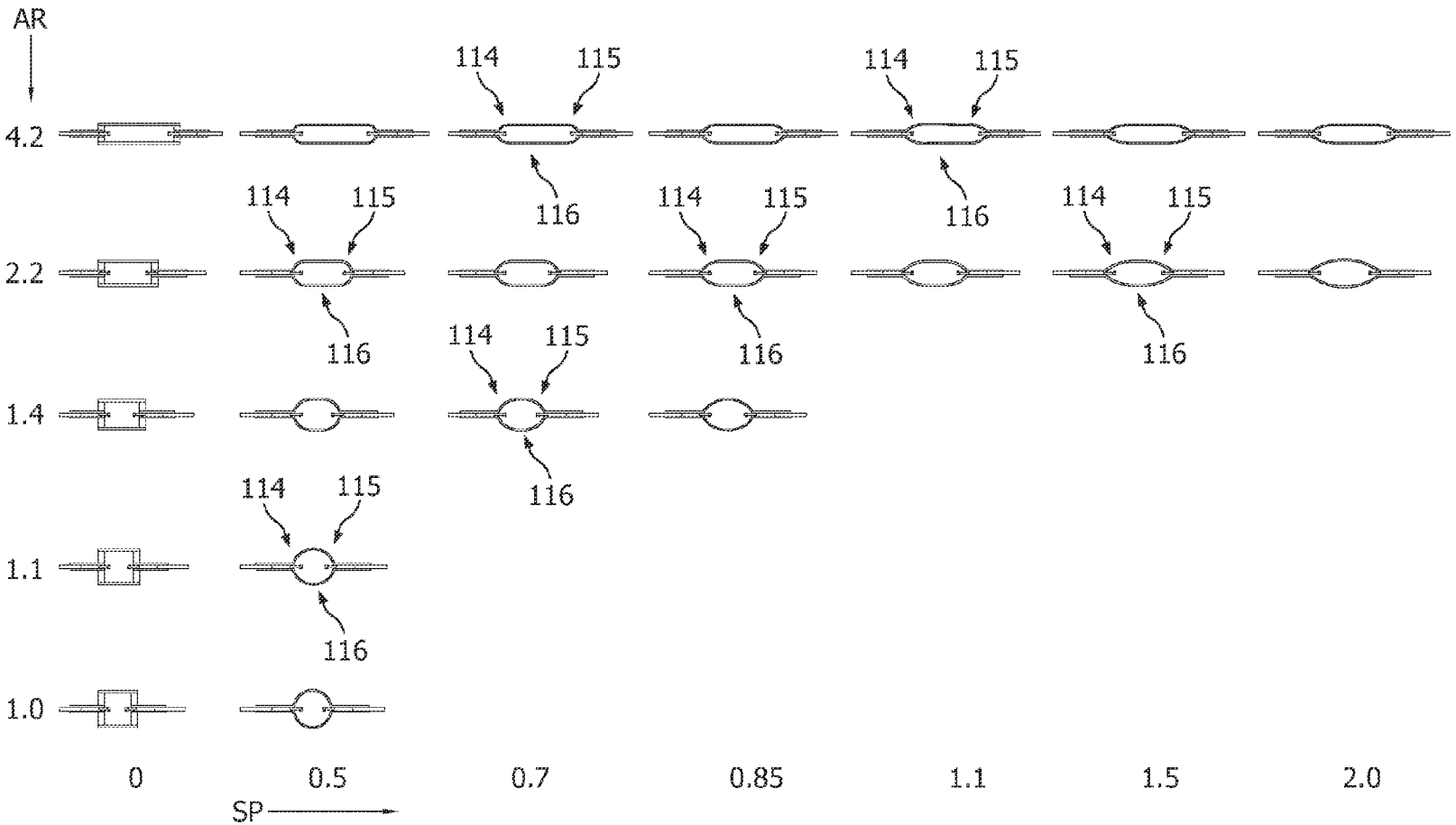
FIG. 4 schematically depicts a number of shaped discharge vessels as a function of the aspect ratio and shape parameter (not on scale)

FIG. 4 schematically depicts a number of possible discharge vessel constructions, both within and outside the aspect ratio and shape parameter values as described herein. Herein, the term "spheroid-like shape" is used since the discharge vessel 1 of the lamp 25 of the invention may have shapes close to spherical at low aspect ratios AR and at small values of the first shape parameter SP. At intermediate aspect ratios and first shape parameter values, the discharge vessel 1 substantially has a spheroid shape. When the aspect ratio AR further increases, especially above about 1.5, the discharge vessel 1 can be characterized by a spheroid having a central cylindrical part. In FIG. 4 this is indicated with cylindrical intermediate part 116, which may be (substantially) absent at low aspect ratios and low shape parameters but which is present especially at relatively high aspect ratios. Hence, the discharge vessel according to a preferred embodiment of the lamp of the invention has shapes in the range from close-to-spherical to cigar-like. These shapes are herein indicated as "spheroid-like shapes".

Since the discharge vessel 1 according to a preferred embodiment has a spheroid-like shape, this also implies that discharge vessel 1 having a shape close to spherical has a radius r3 that is substantially constant over the curved extremities 114,115. However, when the discharge vessel 1 has a shape deviating from close to spherical and has a shape that is more like a spheroid, the radius r3 may in some embodiments vary over the curved extremities 114,115. Radius r3 may therefore also be indicated as mean radius r3. As will be clear to the person skilled in the art, the mean curvature 1/r3 can then be derived by integration of the local curvature along the contour of the curved part and dividing by the length of the contour along which the curvature is integrated The discharge vessel 1 of the lamp 25 according to a preferred embodiment of the invention is substantially symmetrical around main axis 60. For the sake of understanding, a coordinate system is drawn, wherein the main axis 60 is along the y axis, and the minor axis 61 is along the z axis, perpendicular to the y axis. The discharge vessel 1 is essentially rotationally symmetric around main axis 60. Further, a longitudinal axis 100 through the discharge vessel 1 is drawn. Main axis 60 coincides with part of this longitudinal axis. The optional protruding end plugs 34 and 35 (see above and below), are also rotationally symmetric around the longitudinal axis 100 of the discharge vessel (and thus in fact also around main axis 60).

The discharge vessel according to a preferred embodiment has a largest internal radius r1, i.e. the length of a perpendicular from main axis 60 to the internal surface 12 of vessel wall 30 and a largest external radius r2, i.e. the length of a perpendicular from main axis 60 to the external surface 13 of vessel wall 30. Hence, the discharge vessel 1 has a wall thickness w1 which is equal to r2-r1. Preferably, the wall thickness w1 is substantially equal all over the discharge vessel wall 30. Preferably, the discharge vessel 1 has a wall thickness w1 in the range of 0.5-2 mm, more preferably about 0.8-1.2 mm. As indicated in FIG. 3, the discharge vessel 1 also has a largest internal diameter d1, i.e. the largest diameter of the vessel from internal surface 12 to an opposite internal surface measured along a perpendicular to main axis 60. This internal diameter d1 is equal to the length of the minor axis 61 within the discharge vessel 1. Further, the discharge vessel 1 has a maximum external diameter d2. The external diameter d2 is equal to the length of the minor axis 61. As will be clear to the person skilled in the art, (d1+d2)/2=w1.

The part or region of the discharge vessel 1 with the largest diameter d2 is indicated as intermediate region 116. In fact, the discharge vessel 1 of the invention can be seen as two curved parts or curved extremities 114,115 between which an intermediate region 116 is found which may for instance be cylindrical. These regions or parts 114, 115 and 116 are only indicated for the sake of simplicity.

The extremities 114 and 115 of the discharge vessel 1 are curved. Note that in the Figures here, protruding end plugs 34 and 35 are connected to these extremities. The protruding end plugs are optional, and are also discussed below. These curved extremities have a certain curvature (or mean curvature) with radius r3 (see above). Since the discharge vessel is rotationally symmetric around its main axis 60, and preferably also symmetric around its minor axis 61, the curvature of these curved extremities 114,115 is the same at each side of an intersection (vertex) of the main axis 60 and minor axis 61. The vessel 1 is characterized by AR=L1/d2, where $1.1 \leqq L1/d2 \leqq 2.2$ and the first shape parameter SP=r3/d2, where $0.7 \leqq r3/d2 \leqq 1.1$.

The curved extremities 114 and 115 have openings 54 and 55 which are arranged to enclose or surround at least partially the electrodes 4 and 5. Note that the electrodes 4,5, or more precisely the current lead-through conductors 20,21 may be directly sintered to the discharge vessel wall 30, but may also be partially integrated into protruding end plugs 34,35. Further, the current lead-through conductors 20,21 may also be directly sintered into the protruding end plugs 34,35, respectively, or may be sealed into the protruding end plugs 34,35 with seals 10. Anyhow, the current lead-through conductors 20,21 are arranged in discharge vessel 1 in a vacuum tight manner.

The electrodes 4,5 enter the discharge vessel 1 via openings 54 and 55, which openings 54,55 surround at least part of the electrodes. The distance from the openings 54,55 to each other, or the distance from one side of the main axis 60 to the other side of the main axis 60 is indicated as length L1 (or outer length L1) of the discharge vessel 1. Hence, length L1 is equal to the length of the main axis 60 and diameter d2 is equal to the length of the minor axis 61. The electrodes 4,5 have electrode tips 4*b* and 5*b*, which are arranged at a distance L3 from each other. This distance is often also indicated as ED or also EA. Note that the electrodes 4,5 are located in the discharge vessel 1 along main axis 60.

Hence, the invention provides a metal halide lamp 25 comprising a ceramic discharge vessel 1, the discharge vessel 1 having a vessel wall 30 enclosing a discharge space 22 containing an ionisable filling, the discharge space 22 further enclosing electrodes 4,5 having electrode tips 4*b*,5*b*, arranged opposite each other and arranged to define a discharge arc between the electrode tips 4*b*,5*b* during operation of the lamp 25, the discharge vessel 1 having a spheroid-like shape with main axis 60 and outer length L1, the discharge vessel 1 having a largest internal diameter d1 and a largest outer diameter d2, the discharge vessel 1 further having curved extremities 114,115, and openings 54,55 at the curved extremities 114,115, the openings 54,55 being arranged to surround the electrodes 4,5 or the current lead-through conductors 20,21, and the curved extremities 114,115 having a curvature r3, and the aspect ratio being AR=L1/d2, where $1.1 \leqq L1/d2 \leqq 2.2$, and the first shape parameter being SP=r3/d2, where $0.7 \leqq r3/d2 \leqq 1.1$.

It appears that under these shape conditions with respect to aspect ratio AR and shape parameter SP, and especially when using the preferred ionisable fillings as described above (i.e. NaI, TlI, $CaI_2$ and X-iodide and optionally $MnI_2$ and/or InI), lamps 25 are provided with excellent optical properties, maintenance, efficacy and universal burning.

It appears that at larger or smaller values of the first parameter SP and aspect ratio AR, especially at powers above about 150 W, often cracks are found leading to failure of the lamp. In some cases, at an aspect ratio AR close to about 1.0, a relatively low efficacy is found. In other cases, when a shape parameter SP of for instance 0.5 is used, often cracks in the wall of the discharge vessel are observed, especially at high powers. For lower values of L1/d2 the efficacy is reduced. For higher values of L1/d2 the risk of failures increases. When the shape parameter r3/d2 is too low or too high, also the risk of failures increases. Hence, it appears that especially under the conditions of the discharge vessel 1 as defined above, the lamp 25 of the invention has the advantages of high efficacy, good maintenance, a universal burning position and good optical properties (relatively high values for Ra and good color temperature CCT) and a long life. Efficacies of at least 100 μm/W during operation (stable operation at rated power) can be reached, even efficacies of at least 105 μm/W can be obtained for the lamp 25 of the invention (at stable operation at rated power).

Especially lamps 25 wherein the first shape parameter is $0.75 \leqq r3/d2 \leqq 0.9$ and/or wherein the aspect ratio is $1.3 \leqq L1/d2 \leqq 1.7$ are advantageous lamps in terms of efficacy, color rendering and long life.

Lamps of any wattage can be made, such as between about 20 W nominal operation power and about 150 W nominal operation power.

Furthermore, lamps can be made with wattages above 100 W, preferably above 150 W (even up to or above 1000 W) that are suitable for a universal burning position. Hence, the rated power of the lamp 25 may be larger than 100 W, preferably in the order of about 150 W or higher, preferably in the range of 150-1000 W, although higher powers are also possible. Characteristic wattages are for instance 150 W, 210 W, 315 W, 400 W, 600 W and 1000 W. These values refer to nominal operation power. Hence, lamps can be made with powers at nominal operation in the range between 20 and 1000 W.

In addition, it appears that the ratio of the distance between the electrode tips 4*b*,5*b* L3 and the length L1 of the discharge vessel 1 is advantageously in the range of 0.4-0.7. In this way, the distance from the electrode (tips) to the discharge vessel wall 30, i.e. especially its internal surface 12, is sufficient such that crack formation is prevented or diminished. Hence, the ratio L3/L1, indicated as second space parameter SPP, is preferably $0.4 \leqq L3/L1 \leqq 0.7$. When the second space parameter SPP=L3/L1 is lower than about 0.4 the lamp efficacy becomes too low and when the second space parameter is above 0.7, the electrode tips 4*b*,5*b* may come too close to the wall 30, which leads to cracking of the discharge vessel 1, In a specific variant, which is preferably applied, the discharge vessel 1 further comprises protruding end plugs 34,35, such as schematically depicted in FIGS. 2-4. These protruding end plugs 34,35 may be integral with discharge vessel wall 30. The protruding end plugs 34,35 are rotationally symmetric around longitudinal axis 100, and are arranged to enclose the current lead-through conductors 20 and 21, respectively. The conductors 20,21 may be sealed into the protruding end plugs 34,35 by means of sealing 10 or may directly be sealed into the plugs 34,35, without using a separate sealing material to form sealing 10. The protruding end plugs have an internal diameter d6, d7 and an external diameter d4,d5, respectively. Further, the protruding end plugs 34,35 have a wall width w2, which is preferably substantially equal to wall width w1 of ceramic discharge vessel wall 30.

The plugs 34,35 have a length L4,L5, respectively, which are preferably substantially equal. Hence, the openings 54,55 at the curved extremities 114,115 may in an embodiment be arranged to surround the electrodes 4,5 (especially when no protruding end plugs 34,35 are used) and may in another embodiment be arranged to surround the current lead-through conductors 20,21.

The wall 30 of discharge vessel 1 may at the end of the extremities 114,115 show a further curvature, different from the curvature with radius r3, in the direction of the protruding end plugs 34,35. This curvature is indicated with radius r4. This curved part is in general only a minor part of the curved extremities 114,115. The curvature radius r4 is in general in the order of about 0.5-3.0 mm, preferably 1.0-2.0 mm.

The invention also relates to a metal halide lamp 25 to be used in a vehicle headlamp and to a headlamp comprising the lamp 25 according to the invention.

EXAMPLES

A large number of experimental lamps were made. On the one hand, examples and comparative examples comprising discharge vessels 1 described herein and fulfilling the above described criteria were made and measured, and on the other hand discharge vessels having aspect ratios and shape parameters outside the above described criteria were made and measured. An overview is given of the lamps made, with discharge vessel dimensions in Table 1, fillings in Table 2 and results in Table 3:

TABLE 1

Design of discharge vessels (burners) of experimental lamps:

| Lamp | AR = L1/d2 | SP = r3/d2 | SPP = L3/L1 | d1 mm | L1 mm | r3 mm | r4 mm | d2 mm | w1 mm | L4, L5 mm | d4, d5 mm | d6, d7 mm | L3 mm |
|---|---|---|---|---|---|---|---|---|---|---|---|---|---|
| ref. lamp | 1.41 | 0.83 | 0.62 | 16.4 | 26.0 | 15.3 | 2.0 | 18.4 | 1.0 | 17.8 | 4.0 | 1.6 | 16.0 |
| 5 | 1.43 | 0.83 | 0.52 | 13.3 | 21.3 | 12.3 | 2.0 | 14.9 | 0.8 | 18.0 | 2.6 | 1.0 | 11.0 |
| 7 | 1.42 | 0.83 | 0.57 | 10.8 | 17.6 | 10.3 | 1.5 | 12.4 | 0.8 | 16.0 | 2.6 | 1.0 | 10.0 |
| 11 | 1.43 | 0.83 | 0.56 | 13.3 | 21.3 | 12.3 | 2.0 | 14.9 | 0.8 | 18.0 | 2.6 | 1.0 | 12.0 |
| lamp with 0.9 mol % InI | 1.41 | 0.83 | 0.62 | 16.4 | 26.0 | 15.3 | 2.0 | 18.4 | 1.0 | 17.8 | 4.0 | 1.6 | 16.0 |
| lamp with 1.9 mol % InI | 1.41 | 0.83 | 0.62 | 16.4 | 26.0 | 15.3 | 2.0 | 18.4 | 1.0 | 17.8 | 4.0 | 1.6 | 16.0 |
| lamp with 2.7 mol % InI | 1.51 | 0.94 | 0.55 | 8.4 | 14.6 | 9.1 | 2.0 | 9.7 | 0.65 | 12.7 | 2.4 | 0.8 | 8.0 |

TABLE 2

Fillings of the experimental lamps:

| Lamp | Hg dose (mg) | Ar fill pressure (mbar) | Salt dose (mg) | Salt composition (mol %) |
|---|---|---|---|---|
| ref. lamp | 43 | 400 | 30 | NaI 23.9/TlI 2.9/$CaI_2$ 71.8/$CeI_3$ 1.3 |
| 5 | 17 | 100 | 16 | NaI 4.3/TlI 1.2/$CaI_2$ 90.5/$CeI_3$ 3.2/ InI 0.9 |
| 7 | 12 | 100 | 16 | NaI 4.3/TlI 1.2/$CaI_2$ 90.5/$CeI_3$ 3.2/ InI 0.9 |
| 11 | 17 | 100 | 17 | NaI 10.5/TlI 1.1/$CaI_2$ 81.3/$CeI_3$ 1.9/ InI 0.8/$MnI_2$ 4.4 |
| lamp with 0.9 mol % InI | 18 | 400 | 30 | NaI 4.3/TlI 1.2/$CaI_2$ 90.5/$CeI_3$ 3.2/ InI 0.9 |
| lamp with 1.9 mol % InI | 18 | 400 | 30 | NaI 4.3/TlI 1.1/$CaI_2$ 89.6/$CeI_3$ 3.1/ InI 1.9 |
| lamp with 2.7 mol % InI | 7.5 | 400 | 8 | NaI 13.2/TlI 3.7/$CaI_2$ 77.9/$CeI_3$ 2.5/ InI 2.7 |

TABLE 3

Results of the experimental lamps:

| Lamp | Wattage (W) | Lumen output (lm) | Efficacy (lm/W) | CCT (K) | CRI | failures |
|---|---|---|---|---|---|---|
| Ref. Lamp | 320 | 39216 | 123 | 3022 | 90 | no |
| 5 | 210 | 23809 | 113 | 4052 | 85 | no |
| 7 | 143 | 16409 | 115 | 4560 | 86 | no |
| 11 | 205 | 23741 | 116 | 3819 | 95 | no |
| lamp with 0.9 mol % InI | 320 | 38080 | 119 | 4230 | 88 | no |
| lamp with 1.9 mol % InI | 320 | 37760 | 118 | 4206 | 89 | no |
| lamp with 2.7 mol % InI | 100 | 10852 | 108 | 2929 | 86 | no |

Table 4 (and FIG. 5, curve "b") shows the dim behaviour of a lamp (lamp with 2.7 mol % InI) according to the invention, including light-technical data:

TABLE 4

Results of an experimental lamp according to an embodiment of the invention (see also curve (b) in FIG. 5:

| Power (%) | Efficacy (lm/W) | x (CIE) | y (CIE) | Tc (K) | CRI |
|---|---|---|---|---|---|
| 30 | 58.7 | 0.2996 | 0.3046 | 7664 | 75 |
| 40 | 76.4 | 0.3381 | 0.3260 | 5221 | 83 |
| 50 | 86.3 | 0.3690 | 0.3366 | 4019 | 87 |
| 60 | 94.2 | 0.3890 | 0.3405 | 3431 | 87 |
| 70 | 99.2 | 0.4023 | 0.3430 | 3115 | 86 |
| 81 | 103.3 | 0.4123 | 0.3466 | 2932 | 86 |
| 91 | 106.2 | 0.4136 | 0.3480 | 2919 | 85 |
| 100[1] | 108.4 | 0.4146 | 0.3509 | 2930 | 86 |

[1]% of nominal operation power

As can be seen in FIG. 5 and in the above table, the lamp according to the invention (indicated with "b"; this is the lamp with 2.7 mol InI) "follows" the BBL (indicated with "a") while dimming from 100% of nominal power (i.e. nominal operation) to about 30% of nominal power. The distance to the BBL is in the range of 15 SDCM, more preferably 10 SDCM (i.e. 0-10 SDCM). However, lamps without the herein prescribed InI, as shown in FIG. 5 with reference "c" and "d" ("d" is comparable to the reference lamp indicated in the above tables; "c" is another type of ceramic discharge lamps not comprising InI (master color CDM-T 70 W/830 lamp), substantially deviate from the BBL, leading to a lamp with undesired light-technical properties at powers below nominal operation. In the Figure there is indicated at point AA the color point of the inventive lamp having 2.7 mol % In when the lamp is operated with a wall loading on the outside surface of 35.3 W/cm$^2$, which means an operating power of 138 W, being more than the nominal value. As is visible, the color point deviates sharply from the color points in the power range of 100% to 30% of the nominal power. The color point has the coordinates (x,y) (0.410; 0.375).

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A metal halide lamp (25) comprising a ceramic discharge vessel (1), the discharge vessel (1) enclosing a discharge volume (11) containing an ionisable salt filling, the ionisable salt filling comprising 4-30 mol % sodium iodide, 0.5-3.5 mol % thallium iodide, 65-92 mol % calcium iodide, 0.5-5.5 mol % cerium iodide and 0.5-3.5 mol % indium iodide, wherein the mol percentages are relative to the total amount of ionisable salt filling.

2. The metal halide lamp (25) according to claim 1, wherein the ionisable salt filling comprises 0.5-3 mol % indium iodide.

3. The metal halide lamp (25) according to claim 1, wherein the lamp has an external wall load of 20-30 W/cm$^2$.

4. The metal halide lamp (25) according to claim 1, wherein the ionisable salt filling further comprises one or more elements selected from the group consisting of scandium, yttrium and rare earth metals other than Ce, wherein the molar percentage ratio X-iodide/(NaI+TlI+$CaI_2$+InI+X-iodide) is above 0% and up to a maximum of 10%, and wherein X-iodide refers to Ce and the optional one or more elements selected from the group consisting of scandium, yttrium and rare earth metals other than Ce.

5. The metal halide lamp (25) according to claim 1, wherein the amount of NaI, TlI, $CaI_2$, InI and X-iodide in the discharge vessel (1) is in the range of 0.001-0.5 g/cm$^3$, wherein X-iodide refers to Ce and optional one or more elements selected from the group consisting of scandium, yttrium and rare earth metals other than Ce.

6. The metal halide lamp (25) according to claim 1, having an efficacy of at least 100 μm/W at nominal operation and an efficacy of at least 80 μm/W at 50% of nominal operation, and having a CRI of at least 85 in the range of 50-100% of nominal operation.

7. The metal halide lamp (25) according to claim 1, emitting light, during operation, having a color temperature CCT above 2800 K.

8. The metal halide lamp (25) according to claim 1, wherein the ionisable salt filling further comprises 0.5-10 mol % Mn iodide.

9. The metal halide lamp (25) according to claim 1, wherein the discharge vessel (1) has a vessel wall (30) enclosing a discharge space (22) with the ionisable filling, wherein the discharge space (2) further encloses electrodes (4,5) having electrode tips (4*b*,5*b*), arranged opposite of each other and arranged to define a discharge arc between the electrode tips (4*b*,5*b*) during operation of the lamp (25), wherein the discharge vessel (1) has a spheroid like shape with a main axis (60) and a length L1, the discharge vessel (1) having a largest internal diameter d1 and a largest outer diameter d2, the discharge vessel (1) further having curved extremities (114, 115), wherein the curved extremities (114,115) have a curvature with radius r3, wherein an aspect ratio $L1/d2$ is $1.1 \leqq L1/d2 \leqq 2.2$ and wherein a shape parameter $r3/d2$ is $0.7 \leqq r3/d2 \leqq 1.1$.

10. The metal halide lamp (25) according to claim 9, wherein the electrode tips (4*b*,5*b*) are arranged at a distance L3 of each other such that $0.4 \leqq L3/L1 \leqq 0.7$.

11. The metal halide lamp (25) according to claim 9, wherein the shape parameter is $0.75 \leqq r3/d2 \leqq 0.9$.

12. The metal halide lamp (25) according to claim 9, wherein the aspect ratio is $1.3 \leqq L1/d2 \leqq 1.7$.

13. The metal halide lamp (25) according to claim 9, wherein the discharge vessel (1) has a wall thickness (w1) in the range of 0.5-2 mm.

14. The metal halide lamp (25) according to claim 9, wherein the discharge vessel (1) further comprises protruding end plugs (34,35), and the protruding end plugs (34,35) surround at least part of the electrodes (4,5).

* * * * *